US007850010B2

(12) United States Patent
Takev

(10) Patent No.: US 7,850,010 B2
(45) Date of Patent: Dec. 14, 2010

(54) SCREEN DEVICE AND METHOD OF MAKING THE SAME

(75) Inventor: Dieter Takev, St. Catharines (CA)

(73) Assignee: Tylinter, Inc., Mentor, OH (US)

( * ) Notice: Subject to any disclaimer, the term of this patent is extended or adjusted under 35 U.S.C. 154(b) by 0 days.

(21) Appl. No.: 11/728,441

(22) Filed: Mar. 26, 2007

(65) Prior Publication Data

US 2007/0278137 A1 Dec. 6, 2007

Related U.S. Application Data

(60) Provisional application No. 60/785,497, filed on Mar. 24, 2006.

(51) Int. Cl.
*B07B 1/49* (2006.01)

(52) U.S. Cl. ..... 209/393; 209/395; 209/397; 209/399; 209/405

(58) Field of Classification Search ..... 209/314, 209/393, 395, 392, 397, 399, 405
See application file for complete search history.

(56) References Cited

U.S. PATENT DOCUMENTS

| | | | | |
|---|---|---|---|---|
| 760,590 | A * | 5/1904 | Vodra | 209/393 |
| 2,443,176 | A | 6/1948 | Banning | |
| 3,334,744 | A * | 8/1967 | Howell et al. | 209/394 |
| 3,664,503 | A * | 5/1972 | Felden | 209/397 |
| 3,848,744 | A | 11/1974 | Flaherty | |
| 3,943,054 | A * | 3/1976 | Simonson | 209/392 |
| 4,120,784 | A * | 10/1978 | Hassall | 209/399 |
| 4,361,240 | A * | 11/1982 | Davis et al. | 209/674 |
| 4,956,078 | A * | 9/1990 | Magerowski et al. | 209/254 |
| 5,219,076 | A * | 6/1993 | Crosby et al. | 209/210 |
| 5,219,078 | A * | 6/1993 | Hadden | 209/234 |
| 5,769,240 | A * | 6/1998 | Middour et al. | 209/314 |
| 5,816,412 | A * | 10/1998 | Bokor | 209/326 |
| 6,116,428 | A | 9/2000 | Loshe | |
| 7,090,083 | B2 * | 8/2006 | Russell et al. | 209/405 |
| 7,303,079 | B2 * | 12/2007 | Reid-Robertson et al. | 209/405 |
| 2007/0221546 | A1 * | 9/2007 | Mathis et al. | 209/393 |

FOREIGN PATENT DOCUMENTS

| | | | |
|---|---|---|---|
| GB | 2247850 | A | 3/1992 |

* cited by examiner

*Primary Examiner*—Gene Crawford
*Assistant Examiner*—Terrell H Matthews
(74) *Attorney, Agent, or Firm*—McDonald Hopkins LLC

(57) ABSTRACT

The present invention provides a screen for separating materials according to particle size. The screen has a body, a plurality of fingers, and a plurality of rods. The fingers may be integrally formed with the body. The rods are supported within the body and extend within the fingers to provide structural stability.

16 Claims, 1 Drawing Sheet

SCREEN DEVICE AND METHOD OF MAKING THE SAME

CROSS-REFERENCE TO RELATED APPLICATIONS

This application claims priority from U.S. Provisional Patent Application No. 60/785,497, entitled "Cantilever Rod Screen" filed on Mar. 24, 2006, which is hereby incorporated by reference herein.

FIELD OF THE INVENTION

This invention relates to a screen for separating materials and, more particularly, to a cantilever rod screen and method of making the same.

BACKGROUND OF THE INVENTION

Vibrating screen machines are used to separate aggregate particles such as topsoil, rock, crushed rock, gravel, sand, landfill material, recycling waste, compost, demolition debris, and the like (herein collectively referred to as "material") into various sizes. These machines typically comprise one or more screens containing perforated plates, molded plastic with holes, wire cloth screens, or a plurality of evenly spaced fingers, which together act as a sieve through which the material is separated. In screens with a plurality of fingers, a charge of material typically is deposited on the receiving end of the screen and, as the machine vibrates, the fingers vibrate, conveying the material across the fingers to the discharge end. As the material is conveyed across the fingers, smaller material falls through the openings, allowing the larger material to continue across the fingers to a location separate from the smaller particles. Accordingly, the fingers must be strong enough to support the weight of the material, yet flexible enough to withstand vibration.

Most screens have rod-like metallic fingers that are individually bolted or welded to a support bracket, or clamped in a flexible clamp block to withstand vibrations. However, such screens have numerous parts and require extensive assembly time, making them expensive to manufacture and install. In addition, fingers that are rigidly attached by bolts and welds are subject to mechanical failure at their point of attachment, while clamped fingers may loosen during operation.

These fingers are also susceptible to abrasion and lodging of material between the fingers, which produces bowing and spacing between the fingers, resulting in poor screening. Attempts have been made to protect the metallic fingers by coating them with a thin layer of wear-resistant material. However, such coatings do not provide a sufficient volume of wear material to adequately protect the fingers during use. Alternatively, fingers made exclusively of flexible, wear-resistant material do not provide sufficient stiffness to satisfactorily separate materials. Therefore, it is desired to provide an inexpensive screen with fewer parts that eliminates the typical stress points and avoids loosening during operation. It is also desired to provide a screen having both increased wear-resistance and sufficient stiffness for separating materials according to particle size.

Additional information will be set forth in the description which follows, and in part will be obvious from the description, or may be learned by practice of the invention.

SUMMARY OF THE INVENTION

The present invention relates to a screen for separating materials according to particle size. The screen has a body, a plurality of fingers, and a plurality of rods. The fingers may be integrally formed with the body. The rods may have a first end supported within the body and a second end extending within the fingers to provide structural stability.

In another aspect, the present invention is directed to a method for producing a screen that comprises providing a mold having a cavity, positioning a plurality of rods in the cavity, inserting a material to substantially fill the cavity, and molding a screen having a body and a plurality of fingers integrally formed with and extending from the body, so that the first end of each rod is supported within the body and the second end of each rod extends within the fingers to provide structural stability.

DESCRIPTION OF THE DRAWINGS

Operation of the invention may be better understood by reference to the following detailed description taken in connection with the following illustrations, wherein.

DETAILED DESCRIPTION

While the present invention is described with reference to the embodiments described herein, it should be clear that the present invention should not be limited to such embodiments. Therefore, the description of the embodiments herein is merely illustrative of the present invention and should not limit the scope of the invention as claimed.

Figure 1:
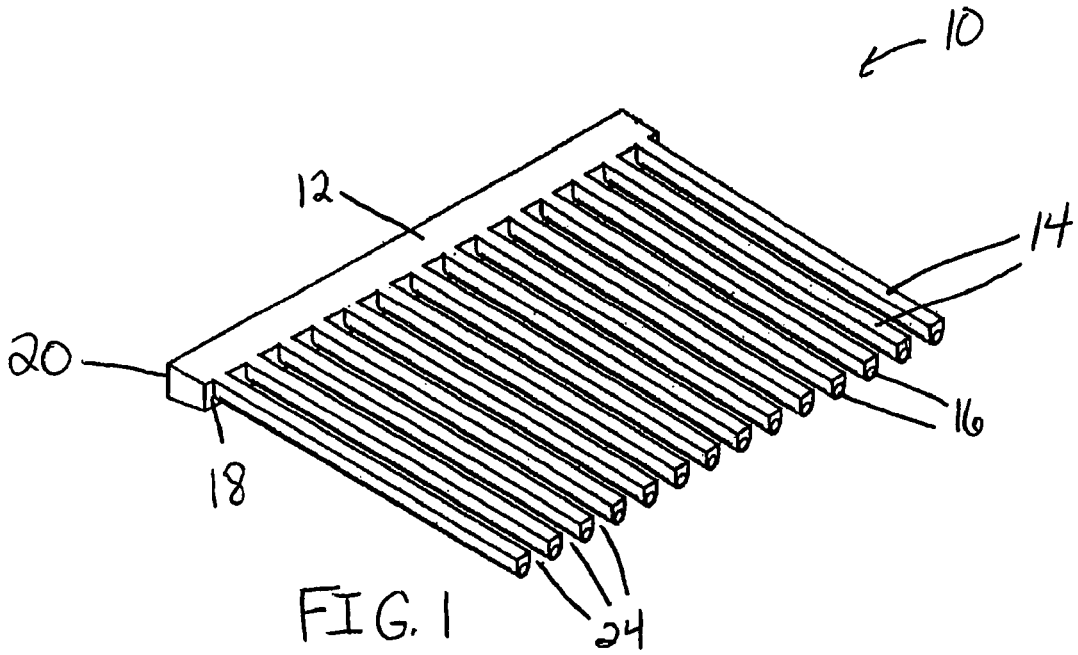
FIG. 1 is a perspective view of a cantilever rod screen in an embodiment of the invention.
Figure 2:
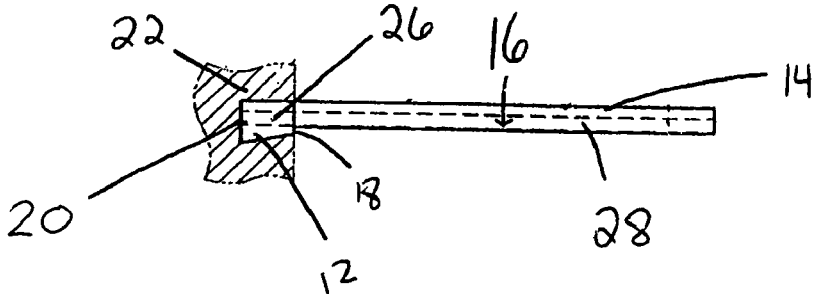
FIG. 2 is a side view of the screen of FIG. 1.
Figure 3:
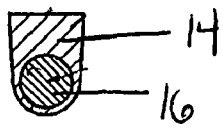
FIG. 3 is a cross-sectional view of a screen finger in an embodiment of the invention.

Reference will now be made in detail to the embodiments of the invention as illustrated in the accompanying figures. Embodiments of a cantilever rod screen 10 are shown in FIGS. 1 through 3. The screen 10 generally has a body 12 with a plurality of fingers 14 and a plurality of rods 16.

As shown in FIG. 1, the body 12 may have an elongated, substantially trapezoidal or wedge-shape, with a face 18 located at an opposing end of a rear wall 20. As best shown in FIG. 2, the perimeter of the body 12 leading from the rear wall 20 to the face 18 may be tapered to facilitate installation in a fixture 22 of a vibrating screen machine. The body 12 may be fabricated from any known material having flexible and wear-resistant properties. Typically, the body 12 may be fabricated from a polymeric material, such as polyurethane or rubber. However, the body 12 should not be deemed as limited to any specific shape or material. One of ordinary skill in the art will appreciate the use of various shapes and materials for the body 12.

The fingers 14 are attached to the body 12 and are capable of freely vibrating. In one embodiment, the fingers 14 may be integrally formed with the body 12. As shown in FIG. 1, the fingers 14 may be substantially rectangular in shape and composed of the same flexible, wear-resistant material as the body 12. As best shown in FIG. 1, the fingers 14 may be arranged substantially parallel to each other in a substantially coplanar row extending substantially perpendicularly outward from the face 18. Accordingly, the row of fingers 14 defines an array of sieve-like openings 24 of a predetermined size for allowing material of up to a predetermined size to pass through the fingers 14.

As best shown in FIG. 2, the rods 16 have a first end 26 embedded and/or molded in the body 12 and a second end 28 extending outwardly from the face 18 and through the fingers 14. The rods 16 support the fingers 14 to provide sufficient stiffness for material separation. As best shown in FIG. 3, the rods may be embedded within the fingers 14 by a molding process, and may extend the length of the fingers 14. The rods 16 may be composed of metals, polymers, combinations or composites thereof, or other suitable materials. In addition, although illustrated as cylindrical in shape, the rods 16 should not be deemed as limited to any specific shape. One of ordinary skill in the art will appreciate the use of various shapes for the rods 16.

Turning to the screen 10, an example of how to use the screen 10 as illustrated in FIGS. 1-3 is set forth below. As shown in FIG. 2, the body 12 is positioned in a fixture cavity 22 of a vibrating screen machine. When in place, the machine may begin vibrating and particulate material may be fed to the screen 10. The free vibration of the wear-resistant fingers 14 may separate any agglomeration or stratification of the material and may provide an improved self-cleaning action that prevents the clogging of the fingers 14 typically occurring in conventional screens. The vibrating action of the fingers may induce lateral movement of the material, wherein smaller material falls through the sieve-like openings 24 while larger material is retained by the fingers 14.

Screens as described herein may be produced in a variety of manners. For example, they may be formed or manufactured by any molding or casting process. Non-limiting, illustrative examples of molding processes include injection, compression, transfer, and reaction injection molding. The mold typically includes a cavity that generally defines the shape of the above-described screen 10. Rods 16 may be positioned in the mold, and a polymeric material may then be inserted into the cavity. Once the screen 10 is formed, the screen 10 can be removed from the mold.

As can be understood from the above description, the screen 10 allows for easy installation and replacement in a vibrating screen machine. The screen 10 can be inexpensively molded, thereby reducing equipment costs. If one or more fingers 14 suffer mechanical failure, the entire screen 10 can be quickly replaced, thereby reducing downtime. Moreover, the individual fingers 14 may not require removal or replacement, resulting in significant labor savings. In addition, the rods 16 may be embedded in a resilient manner in the body 12 by a molding or casting process, reducing or eliminating stress points at which mechanical failure of the rods 16 and fingers 14 occur.

The invention has been described above and, obviously, modifications and alternations will occur to others upon a reading and understanding of this specification. The claims as follows are intended to include all modifications and alterations insofar as they come within the scope of the claims or the equivalent thereof.

I claim:

1. A screen for separating materials according to particle size, said screen comprising:

a body;

a plurality of fingers having a first end integrally formed within said body and a second unattached end, where said fingers are arranged substantially parallel to each other in a substantially coplanar row;

a plurality of rods embedded within said body by a molding process and extending within said fingers, said rods capable of providing structural stability to said fingers; and wherein said rods terminate near said second end of said fingers.

2. The screen of claim 1 wherein said fingers define an array of sieve-like openings of a predetermined size for allowing said materials of a predetermined size to pass therethrough.

3. The screen of claim 1 wherein said fingers are substantially rectangular in shape.

4. The screen of claim 1 wherein said body and said fingers are made of a polymeric material.

5. The screen of claim 1 wherein each of said rods is surrounded by one of said fingers.

6. The screen of claim 1 wherein said rods are made of metal.

7. The screen of claim 6 wherein said rods are substantially cylindrical in shape.

8. A screen for separating materials according to particle size, said screen comprising:

a body;

a plurality of fingers having a first end integrally formed with and extending from said body and a second unattached end, where said fingers define an array of sieve-like openings of a predetermined size for allowing said materials of a predetermined size to pass therethrough;

a plurality of rods each having a first end and a second end, said first end supported within said body and said second end extending within said fingers to provide structural stability to said fingers; and wherein said rods terminate near said second end of said fingers.

9. The screen of claim 8 wherein said fingers are arranged substantially parallel to each other in a substantially coplanar row.

10. The screen of claim 8 wherein said fingers are substantially rectangular in shape.

11. The screen of claim 8 wherein said body and said fingers are made of a polymeric material.

12. The screen of claim 8 wherein said body and said fingers are made of polyurethane.

13. The screen of claim 8 wherein said rods are made of metal.

14. A method for producing a screen, comprising the steps:

providing a mold having a cavity therein;

positioning a plurality of rods in said cavity, each rod having a first end and a second end;

inserting a material into said cavity; and molding said material to produce a screen having a body and a plurality of fingers having a first end integrally formed with and extending from said body and a second unattached end, where said fingers are arranged substantially parallel to each other in a substantially coplanar row, so that said first end of each rod is supported within said body and said second end of each rod extends within said fingers to provide structural stability to said fingers, wherein said rods terminate near said second end of said fingers.

15. The method of claim 14 wherein each of said fingers are molded to surround each of said rods.

16. The method of claim 15 wherein said material is a polymeric material.

* * * * *